US006059886A

United States Patent [19]

Shibano

[11] Patent Number: 6,059,886

[45] **Date of Patent: *May 9, 2000**

[54] METHOD OF ULTRASONICALLY CLEANING WORKPIECE

[75] Inventor: Yoshihide Shibano, Machida, Japan

[73] Assignee: S & C Co., Ltd., Kanagawa-ken, Japan

[ * ] Notice: This patent is subject to a terminal disclaimer.

[21] Appl. No.: 08/066,994

[22] Filed: May 25, 1993

[30] Foreign Application Priority Data

May 25, 1992 [JP] Japan ..... 4-041510 U
Sep. 8, 1992 [JP] Japan ..... 4-239384

[51] Int. Cl.[7] ..... B08B 3/12

[52] U.S. Cl. ..... 134/1; 134/21; 134/26

[58] Field of Search ..... 134/1, 26, 21

[56] References Cited

U.S. PATENT DOCUMENTS 2,997,962 4/1961 Zucker ..... 134/111
4,193,818 3/1980 Young et al. ..... 134/1
4,907,611 3/1990 Shibano ..... 134/60
5,137,580 8/1992 Honda ..... 134/1
5,201,958 4/1993 Breunsbach et al. ..... 134/1
5,202,523 4/1993 Grossman et al. ..... 134/1

FOREIGN PATENT DOCUMENTS 4024552 1/1992 Japan .

*Primary Examiner*—Randy Gulakowski
*Assistant Examiner*—Saeed Chaudhry
*Attorney, Agent, or Firm*—Paul A. Guss

[57] ABSTRACT

An ultrasonic cleaning tank with an ultrasonic vibrator mounted on its bottom is supplied with an aqueous cleaning solution which has been deaerated to a predetermined dissolved oxygen content ranging from 0.01 to 5 ppm. A workpiece to be ultrasonically cleaned is then immersed in the cleaning solution. Thereafter, the ultrasonic vibrator radiates ultrasonic energy into the cleaning solution to remove foreign matter and burrs off the workpiece.

3 Claims, 3 Drawing Sheets

METHOD OF ULTRASONICALLY CLEANING WORKPIECE

BACKGROUND OF THE INVENTION

1. Field of the Invention

The present invention relates to a method of ultrasonically cleaning a workpiece, and more particularly to a method of ultrasonically cleaning a workpiece by supplying a deaerated cleaning solution to a cleaning tank with ultrasonic vibrator mounted on its bottom, and radiating ultrasonic energy from the ultrasonic vibrator into the cleaning solution to clean a molded, cast or machined workpiece immersed in the cleaning solution.

2. Description of the Prior Art

Workpieces such as ground, bored, or abraded metallic workpieces, ground glass or ceramic workpieces, or injection- or extrusion-molded plastic workpieces are often burred immediately after they are formed. Surfaces of such workpieces are smeared by solid foreign matter such as chips, small broken pieces resulting from burrs, and dust particles. To finish these workpieces, it is necessary to remove the burrs and solid foreign matter off their surfaces and clean the surfaces.

Heretofore, it has been customary to clean machined workpieces with a cleaning solution such as an organic solvent of carbon chloride, e.g., perchloroethylene, 1,1,1-trichloroethylene, or the like, or an organic solvent containing chlorofluorocarbon. Though another separate process is necessary to remove burrs which have not completely separated from the workpiece, the above cleaning process is highly effective to remove foreign matter deposited on the workpiece because the foreign matter can be cleaned off simply by immersing the workpiece in a cleaning tank filled with the organic solvent.

However, organic solvents of carbon chloride are difficult to handle because most of them have an anesthetic effect and tend to cause blood related problems if inhaled over a long period of time. It is also pointed out that chlorine contained in molecules of organic solvents containing chlorofluorocarbons are responsible for destroying the ozone layer around the earth. An international agreement has been reached to abolish the use of all organic solvents containing chlorofluorocarbons.

In view of such drawbacks of the conventional cleaning solutions, research efforts have been directed to the use of an aqueous cleaning solution. It is known that the cleaning solution used in an ultrasonic cleaning process has an increased cleaning effect if it is deaerated to reduce the content of dissolved gas therein. The principles behind the increased cleaning effect of such a deaerated cleaning solution are as follows:

In the ultrasonic cleaning process, partial vacuums are formed in the cleaning solution due to cavitation when ultrasonic energy is radiated into the cleaning solution. Since the cavities formed in the cleaning solution contain only a slight amount of vapor of the cleaning solution and are mostly vacuum, they are immediately collapsed under the pressure of the surrounding cleaning solution. When the cavities are collapsed, microjets are developed in the cleaning solution. Inasmuch as the microjets act on the surface of a workpiece to be cleaned which is immersed in the cleaning solution, solid foreign matter deposited on the workpiece is removed, thus cleaning the workpiece.

If the cleaning solution is not deaerated and contains a high concentration of dissolved gas therein, then the gas is evaporated in the cavities, resulting in the creation of gas bubbles in the cleaning solution. If such gas bubbles are generated, then since the pressure of the gas in the gas bubbles acts against the pressure of the surrounding cleaning solution, the cavities are less liable to collapse, resulting in difficulty in producing microjets. Even if microjets are produced, they are dampened by the gas bubbles, and act less effectively on the surface of the workpiece. Once the gas bubbles are produced, ultrasonic energy radiated by the ultrasonic vibrator is absorbed by the gas bubbles, making it difficult to cause cavitation. Consequently, the ultrasonic cleaning process which employs a cleaning solution that is not deaerated is unable to produce any cleaning effect other than a very weak cleaning effect provided by the gas bubbles.

On the other hand, if a deaerated cleaning solution is employed in an ultrasonic cleaning process, stronger microjets are developed because a smaller amount of gas is evaporated in the cavities and exerts a lower surrounding pressure against the pressure of the cleaning solution.

The inventor has found, as a result of research activities with respect to the ultrasonic cleaning process based on the above knowledge, that since powerful microjets acting on the surface of a workpiece to be cleaned are produced upon collapse of cavities in a deaerated cleaning solution, an ultrasonic cleaning process employing an aqueous cleaning solution is effective in removing solid foreign matter off the surface of the workpiece, and much stronger microjets generated in the aqueous cleaning solution are capable of removing burrs that have not fully been separated from the workpiece.

Even when the amount of dissolved gas in the aqueous cleaning solution is greatly reduced, however, the aqueous cleaning solution may fail to provide a sufficient cleaning effect depending on the type of workpiece to be cleaned.

SUMMARY OF THE INVENTION

It is therefore an object of the present invention to provide a method of ultrasonically cleaning a workpiece with a high cleaning effect regardless of the type of workpiece to be cleaned.

The inventor has found, as a result of his study seeking for being unable to achieve a desired cleaning effect simply by reducing the amount of gas dissolved in an aqueous cleaning solution, that the amount of gas dissolved in the aqueous cleaning solution is involved in the process of ultrasonic cleaning and has a suitable content range depending on the workpiece to be cleaned.

To achieve the above object, there is provided in accordance with the present invention a method of ultrasonically cleaning a workpiece, comprising the steps of supplying an ultrasonic cleaning tank having an ultrasonic vibrator mounted on a bottom thereof with an aqueous cleaning solution which has been deaerated to a predetermined dissolved oxygen content ranging from 0.01 to 5 ppm, immersing a workpiece in the cleaning solution, and radiating ultrasonic energy from the ultrasonic vibrator into the cleaning solution to remove foreign matter and burrs off the workpiece. Since the ultrasonic cleaning process is carried out in air, the gas dissolved in the cleaning solution is air. As the air contains oxygen and nitrogen at a ratio of about 1:4 by volume, the amount of oxygen dissolved in the cleaning solution is used to indicate the amount of gas dissolved in the cleaning solution throughout the specification.

The aqueous cleaning solution comprises water, pure water or superpure water with ions removed therefrom depending on the type of workpiece to be cleaned, and may contain a detergent comprising a surface active agent. When an the aqueous cleaning solution containing a surface active agent detergent is used, the surface tension thereof is reduced, and the aqueous cleaning solution easily finds its way into fine cracks and can easily emulsify oil. Therefore, such an aqueous cleaning solution is suitable for use in removing small foreign matter such as dust particles and oil. The surface active agent detergent may comprise a cationic surface active agent, an anionic surface active agent, or a nonionic surface active agent, but should preferably comprise a nonionic surface active agent.

The saturated amount of oxygen dissolved in water at normal temperature is about 8 ppm. Since the aqueous cleaning solution is deaerated to a dissolved oxygen content as described above in the ultrasonic cleaning method according to the present invention, cavities that are created in the aqueous cleaning solution by cavitation when ultrasonic energy is radiated into the cleaning solution are easily collapsed to produce strong microjets.

As a practical matter, it is difficult to reduce the amount of oxygen dissolved in the cleaning solution below 0.01 ppm because air is dissolved into the cleaning solution from its surface in the ultrasonic cleaning tank. If the amount of oxygen dissolved in the cleaning solution exceeded 5 ppm, then when ultrasonic energy is radiated from the ultrasonic vibrator into the cleaning solution, cavities produced by cavitation would not easily be collapsed, and strong microjets could not be produced and applied to the workpiece, thus failing to provide a sufficient cleaning effect.

According to the present invention, the amount of oxygen dissolved in the cleaning solution is adjusted in the above range depending on the type of the workpiece. The workpiece can therefore be ultrasonically cleaned under conditions suitable for the type of the workpiece with a sufficient cleaning effect.

If solid foreign matter such as material residues or dust particles held in direct contact with the workpiece under physical forces such as electrostatic forces is to be removed, then it is preferable that the aqueous cleaning solution be deaerated to a dissolved oxygen content ranging from 0.01 to 3 ppm to remove the solid foreign matter against such physical forces.

If burrs which are not completely separated from the workpiece but remain partly connected thereto are to be removed, then it is preferable that the aqueous cleaning solution be deaerated to a dissolved oxygen content ranging from 0.01 to 0.5 ppm to apply sufficiently strong microjets for separating and removing the burrs from the workpiece.

If solid foreign matter attached to the workpiece by oil is to be removed, then it is preferable that the aqueous cleaning solution contain a surface active agent, and be deaerated to a dissolved oxygen content ranging from 2 to 5 ppm, preferably from 3 to 4 ppm.

Solid foreign matter attached to the workpiece by oil cannot easily be removed simply by strong microjets because the solid foreign matter sticks to the workpiece through the oil. For removing such solid foreign matter, it is also necessary to remove the oil.

Findings by the inventor show that when the dissolved oxygen content is less than 2 ppm, the oil can temporarily be removed by strong microjets, but tends to form relatively large oil droplets. Inasmuch as such oil droplets are not easily be emulsified and dispersed into the cleaning solution, they are attached again to the workpiece. As a consequence, the solid foreign matter cannot easily be removed from the workpiece.

Since it is considered that the oil can easily be emulsified by the gas dissolved in the cleaning solution, the dissolved oxygen content should preferably be 2 ppm or higher for oil removal. If the dissolved oxygen content exceeded 5 ppm, most of the oil on the workpiece would be removed, but oil absorbed into the workpiece would not sufficiently be removed and would tend to remain. At this time, relatively large solid foreign matter would be removed together with most of the oil. However, smaller solid foreign matter would remain attached as a result of the remaining oil because no strong microjets would be applied.

When the cleaning solution is deaerated to adjust the dissolved oxygen content to a range from 2 to 5 ppm, sufficient microjets are applied to remove the oil and the solid foreign matter that remains attached as a result of the oil. The oil removed by the microjets is emulsified and dispersed in the cleaning solution, and will not become attached to the workpiece again. Thus, both the oil and the solid foreign matter are removed from the workpiece.

The method may further comprise the step of deaerating the cleaning solution by introducing the cleaning solution into a sealed tank and evacuating the sealed tank to discharge a gas dissolved in the cleaning solution into a space in the sealed tank.

According to the present invention, the aqueous cleaning solution may be deaerated to a dissolved oxygen content ranging from 0.01 to 5 ppm, and is not required to be deaerated to a dissolved oxygen content lower than 0.01 ppm. Therefore, the cleaning solution may efficiently be deaerated by the above deaerating step. It is not necessary to employ a highly expensive deaerator composed of a plurality of gas separating membrane modules.

The aqueous cleaning solution may be supplied to the ultrasonic cleaning tank after it has been deaerated to the above dissolved oxygen content. The cleaning solution may be deaerated using a deaerator separate from the ultrasonic cleaning tank, and having the above sealed tank and an evacuating device for evacuating the sealed tank.

The method may further comprise the step of heating the cleaning solution to a temperature ranging from 30 to 55° C. When the cleaning solution is heated to the above temperature range, cavities can easily be developed in the cleaning solution by cavitation, and oil can easily be emulsified in the cleaning solution. The cleaning solution may be heated by a heater in the ultrasonic cleaning tank.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
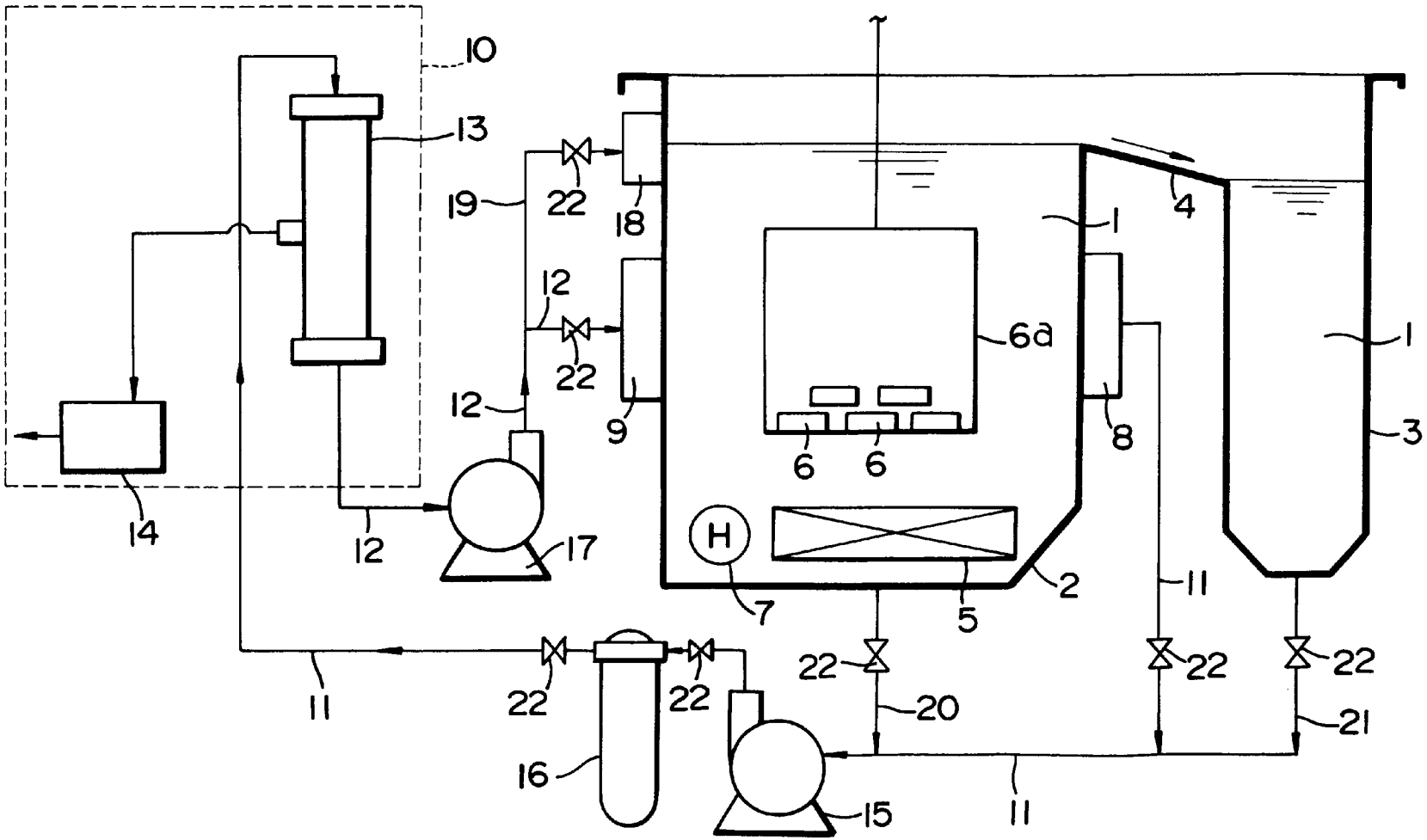
FIG. 1 is a systematic diagram of an ultrasonic cleaning apparatus for carrying out a method of ultrasonically cleaning a workpiece according to the present invention.

As shown in FIG. 1, an ultrasonic cleaning apparatus for carrying out a method of ultrasonically cleaning a workpiece according to the present invention has an ultrasonic cleaning tank 2 for holding a cleaning solution 1 and an overflow tank 3 disposed adjacent to the ultrasonic cleaning tank 2, the ultrasonic cleaning tank 2 and the overflow tank 3 being interconnected by an inclined discharge passage 4. An ultrasonic vibrator 5 is mounted on the bottom of the ultrasonic cleaning tank 2 for radiating ultrasonic energy into the cleaning solution 1 to clean workpieces 6 immersed therein. A heater 7 for heating the cleaning solution 1 is also mounted on the bottom of the ultrasonic cleaning tank 2.

The ultrasonic cleaning tank 2 has a cleaning solution outlet 8 and a cleaning solution inlet 9 which are mounted on a side wall thereof in confronting relationship to each other. Each of the cleaning solution outlet 8 and the cleaning solution inlet 9 has a flow rectifying device (not shown) for smoothing a flow of cleaning solution going therethrough. A deaerator 10 for deaerating the cleaning solution is disposed outside of the ultrasonic cleaning tank 2. The deaerator 10 comprises a sealed tank 13 for holding the cleaning solution 1 therein and a vacuum pump 14 for evacuating the sealed tank 13 to discharge a dissolved gas in the cleaning solution 1 into a space within the sealed tank 13 for thereby deaerating the cleaning solution 1. The deaerator 10 is connected to the cleaning solution outlet 8 by a discharge conduit 11 and to the cleaning solution inlet 9 by a supply conduit 12.

A discharge pump 15 for introducing the cleaning solution 1 discharged from the cleaning solution outlet 8 into the deaerator 10 is connected to the discharge conduit 11 upstream of the deaerator 10. A filter 16 is connected between the deaerator 10 and the discharge pump 15. A supply pump 17 for supplying the deaerated cleaning solution 1 from the deaerator 10 to the ultrasonic cleaning tank 2 is connected to the supply conduit 12 between the deaerator 10 and the cleaning solution inlet 9.

An upper cleaning solution inlet 18 is mounted on an upper wall portion of the ultrasonic cleaning tank 2, and connected to an upper supply conduit 19 which is branched from the supply conduit 12 downstream of the supply pump 17. A cleaning solution discharge conduit 20 and an overflow solution discharge conduit 21 are connected to the respective bottoms of the ultrasonic cleaning tank 2 and the overflow tank 3. The cleaning solution discharge conduit 20 and the overflow solution discharge conduit 21 are connected to the discharge conduit 11. The conduits 11, 12, 19, 20, 21 have flow control valves 22.

The cleaning solution 1 held in the ultrasonic cleaning tank 2 is a mixture of tap water and 5% of a detergent. The detergent comprises an aqueous solution containing 6.0% of a nonionic surface active agent, 7.0% of an inorganic builder, 10.0% of a solubilization agent, and 1.0% of others.

The cleaning solution 1 in the ultrasonic cleaning tank 2 is drawn therefrom through the cleaning solution outlet 8 by the discharge pump 15, and introduced into the deaerator 10 through the discharge conduit 11 via the filter 16. Since the sealed tank 13 of the deaerator 10 is deaerated by the vacuum pump 14, when the cleaning solution 1 is introduced into the sealed tank 13 through the discharge conduit 11, a gas dissolved in the cleaning solution 1 is charged into the evacuated space in the sealed tank 13. At this time, the cleaning solution 1 is deaerated to such an extent that the amount of dissolved oxygen ranges from 0.01 to 5 ppm depending on the type of workpieces 6 to be cleaned. The amount of dissolved oxygen may readily be regulated depending on the type of workpieces 6 to be cleaned by varying the degree to which the sealed tank 13 is evacuated by the vacuum pump 14.

The deaerated cleaning solution 1 is drawn from the deaerator 10 by the supply pump 17, and supplied through the supply conduit 12 and the cleaning solution inlet 9 into the ultrasonic cleaning tank 2. Since the cleaning solution 1 circulates through the ultrasonic cleaning apparatus as described above, the amount of oxygen dissolved in the cleaning solution 1 can be maintained in the above range at all times.

Since the cleaning solution outlet 8 and the cleaning solution inlet 9 have respective flow rectifying devices, a laminar flow directed from the cleaning solution inlet 9 toward the cleaning solution outlet 8 parallel to the ultrasonic vibrator 5 is developed in the cleaning solution 1 in the ultrasonic cleaning tank 2. Such a laminar flow allows cavities or partial vacuums to be easily produced in the cleaning solution 1 due to cavitation.

The ultrasonic vibrator 5 is actuated to radiate ultrasonic energy into the cleaning solution 1 in the ultrasonic cleaning tank 2 for cleaning the workpieces 6 that are immersed in the cleaning solution 1. If the workpieces 6 are relatively small in size, then a number of workpieces 6 are placed in a container 6*a* of stainless steel, and the container 6*a* is immersed in the cleaning solution 1.

When the workpieces 6 are immersed in the cleaning solution 1 in the ultrasonic cleaning tank 2, a portion of the cleaning solution 1 overflows the ultrasonic cleaning tank 2, and is introduced down the discharge passage 4 into the overflow tank 3. The cleaning solution 1 that has been introduced into the overflow tank 3 is then discharged from the overflow tank 3 through the overflow discharge conduit 21 into the discharge conduit 11. The cleaning solution 1 is supplied to and deaerated by the deaerator 10, and the deaerated cleaning solution 1 is supplied to the ultrasonic cleaning tank 2. Therefore, the surface level, the amount of dissolved oxygen, and the temperature of the cleaning solution 1 in the ultrasonic cleaning tank 2 remain unchanged.

The cleaning solution 1 on the bottom of the ultrasonic cleaning tank 2 is drawn through the cleaning solution discharge conduit 20 into the discharge conduit 11, from which the cleaning solution 1 is introduced into the deaerator 10. A portion of the deaerated cleaning solution 1 is supplied from the upper cleaning solution inlet 18 to the ultrasonic cleaning tank 2. The deaerated cleaning solution 1 supplied from the upper cleaning solution inlet 18 is effective to agitate the cleaning solution 1 in the ultrasonic cleaning tank 2 for uniformizing the temperature of the cleaning solution 1 that is heated by the heater 7.

The cleaning solution 1 drawn from the ultrasonic cleaning tank 2 through the conduits 11, 20, 21 contains burrs and solid foreign matter removed from the workpieces 6. These burrs and solid foreign matter are collected by the filter 16 that is positioned in the discharge conduit 11 between the discharge pump 15 and the deaerator 10.

The ultrasonic cleaning apparatus according to this embodiment is not required to deaerate the cleaning solution 1 to such a high extent that the amount of oxygen contained in the cleaning solution 1 is lower than 0.01 ppm. The deaerator 10 is capable of deaerating the cleaning solution 1 to such an extent that the amount of oxygen dissolved in the cleaning solution 1 ranges from 0.01 to 5 ppm. The ultrasonic cleaning apparatus does not need a highly expensive deaerator composed of a plurality of gas separating membrane modules, and hence is relatively simple in overall structure.

Examples of the above ultrasonic cleaning process will be described below.

EXAMPLE 1

In a first example, a cleaning solution 1 that had been deaerated to a dissolved oxygen range from 0.01 to 0.5 ppm was supplied to the ultrasonic cleaning tank 2, and razor blades of stainless steel with small burrs having dimensions of about 100 $\mu$m were immersed as workpieces 6 in the cleaning solution 1. Such burrs which were not completely separated from the razor blades could not have been removed in a normal cleaning process using an organic solvent. In this example, the razor blades were ultrasonically cleaned using a cleaning solution 1 which was deaerated to the above dissolved oxygen range, and the burrs as well as other foreign matter such as dust particles and material residues were removed almost completely. When the amount of dissolved oxygen was in excess of 0.5 ppm, however, the burrs were not fully removed from the razor blades.

EXAMPLE 2

In a second example, a cleaning solution 1 that had been deaerated to a dissolved oxygen content ranging from 0.01 to 3 ppm was supplied to the ultrasonic cleaning tank 2, and sintered parts with solid foreign matter such as material residues and dust particles electrostatically attracted thereto were immersed as workpieces 6 in the cleaning solution 1. When the sintered parts were ultrasonically cleaned in the cleaning solution 1 with the above dissolved oxygen content, the solid foreign matter such as material residues and dust particles was removed substantially completely. As the solid foreign matter such as material residues and dust particles is not joined to the sintered parts, it may be sufficiently removed even when subjected to microjets that are not so powerful as those used to remove the burrs in the first example. However, solid foreign matter such as material residues and dust particles was not fully removed when the dissolved oxygen content exceeded 3 ppm. Workpieces 6 that can effectively be cleaned by the cleaning solution 1 with a dissolved oxygen content ranging from 0.01 to 3 ppm include magnets, acupuncture needles, and piston rods as well as sintered parts. Dust particles and abrasive grain are electrostatically held in direct contact with acupuncture needles. Abrasive grains, grinding materials, and other foreign matter are held in direct contact with piston rods.

EXAMPLE 3

In a third example, a cleaning solution 1 that had been deaerated to a dissolved oxygen content ranging from 2 to 5 ppm was supplied to the ultrasonic cleaning tank 2, and metallic connector pins were immersed as workpieces 6 in the cleaning solution 1. Solid foreign matter, such as material residues including chips produced when the metallic connector pins were machined and small particles produced when burrs were broken, was attached to the metallic connector pins by oil, such as cutting oil used when the metallic connector pins were machined. The cleaning solution 1 was heated to a temperature range of from 30 to 40° C. by the heater 7. When the metallic connector pins were ultrasonically cleaned in the cleaning solution 1 with the above dissolved oxygen content, the oil and the solid foreign matter were removed substantially completely.

However, in Example 3, when the dissolved oxygen content was lower than 2 ppm, the oil removed by microjets did not become emulsified and dispersed in the cleaning solution 1, and hence became attached again to the workpieces 6. Therefore, the foreign matter attached to the workpieces 6 by the oil was not fully removed. When the dissolved oxygen content was in excess of 5 ppm, most of the oil and relatively large foreign matter were removed, but smaller foreign matter attached to the workpieces 6 by oil absorbed into the workpieces 6 was not removed.

Workpieces 6 that can effectively be cleaned by the cleaning solution 1 with a dissolved oxygen content ranging from 2 to 5 ppm include metallic parts for use in watches and clocks, pressed metallic workpieces, injection- and extrusion-molded plastic workpieces, aluminum hoops, and mechanical seals as well as connector pins.

In the above examples, the cleaning solution 1, which is deaerated to the above dissolved oxygen contents depending on the type of workpieces 6 to be cleaned, is supplied to a single ultrasonic cleaning tank 2 for ultrasonically cleaning the workpieces 6. However, a plurality of ultrasonic cleaning tanks 2 may be employed, and a cleaning solution 1 deaerated to a dissolved oxygen content ranging from 2 to 5 ppm may be supplied to the first ultrasonic cleaning tank 2, and a cleaning solution 1 deaerated to a dissolved oxygen content ranging from 0.01 to 0.5 ppm may be supplied to the second ultrasonic cleaning tank 2. According to this modification, workpieces 6 of one type can be ultrasonically cleaned through a plurality of steps. For example, razor blades may be ultrasonically cleaned in the first ultrasonic cleaning tank 2 to remove solid foreign matter attached to the razor blades by oil, and then ultrasonically cleaned in the second ultrasonic cleaning tank 2 to remove burrs from the razor blades.

Experiments were conducted to confirm reasons as to why different dissolved oxygen contents are suitable for different types of workpieces to be cleaned. First, an experimental ultrasonic cleaning apparatus used for ultrasonically cleaning workpieces in the experiments will be described below with reference to FIG. 2. An ultrasonic vibrator 5 is mounted on the bottom of an ultrasonic cleaning tank 2 of acrylic resin which holds a cleaning solution 1. The ultrasonic vibrator 5 radiates ultrasonic energy into the cleaning solution to clean workpieces 6 placed in a container 6*a* and immersed in the cleaning solution 1.

The ultrasonic cleaning tank 2 has a cleaning solution outlet 8 and a cleaning solution inlet 9 which are mounted on a side wall thereof in confronting relationship to each other. Each of the cleaning solution outlet 8 and the cleaning solution inlet 9 has a flow rectifying device (not shown) for smoothing a flow of cleaning solution going therethrough. A deaerator 10, identical to the deaerator 10 shown in FIG. 1, for deaerating the cleaning solution is disposed outside of the ultrasonic cleaning tank 2. The deaerator 10 is connected to the cleaning solution outlet 8 by a discharge conduit 11 and to the cleaning solution inlet 9 by a supply conduit 12.

A circulation pump 22 for introducing the cleaning solution 1 discharged from the cleaning solution outlet 8 into the deaerator 10 and supplying the deaerated cleaning solution to the ultrasonic cleaning tank 2 is connected to the discharge conduit 11 upstream of the deaerator 10. Filters 23*a*, 23*b* are connected between the deaerator 10 and the circulation pump 22.

A bypass conduit 24 and a flow control valve 25 are connected to the discharge conduit 11, the bypass conduit 24 being connected between upstream and downstream sides of the circulation pump 22. The bypass conduit 24 can be opened and closed by a flow control valve 26 connected thereto.

Figure 2:
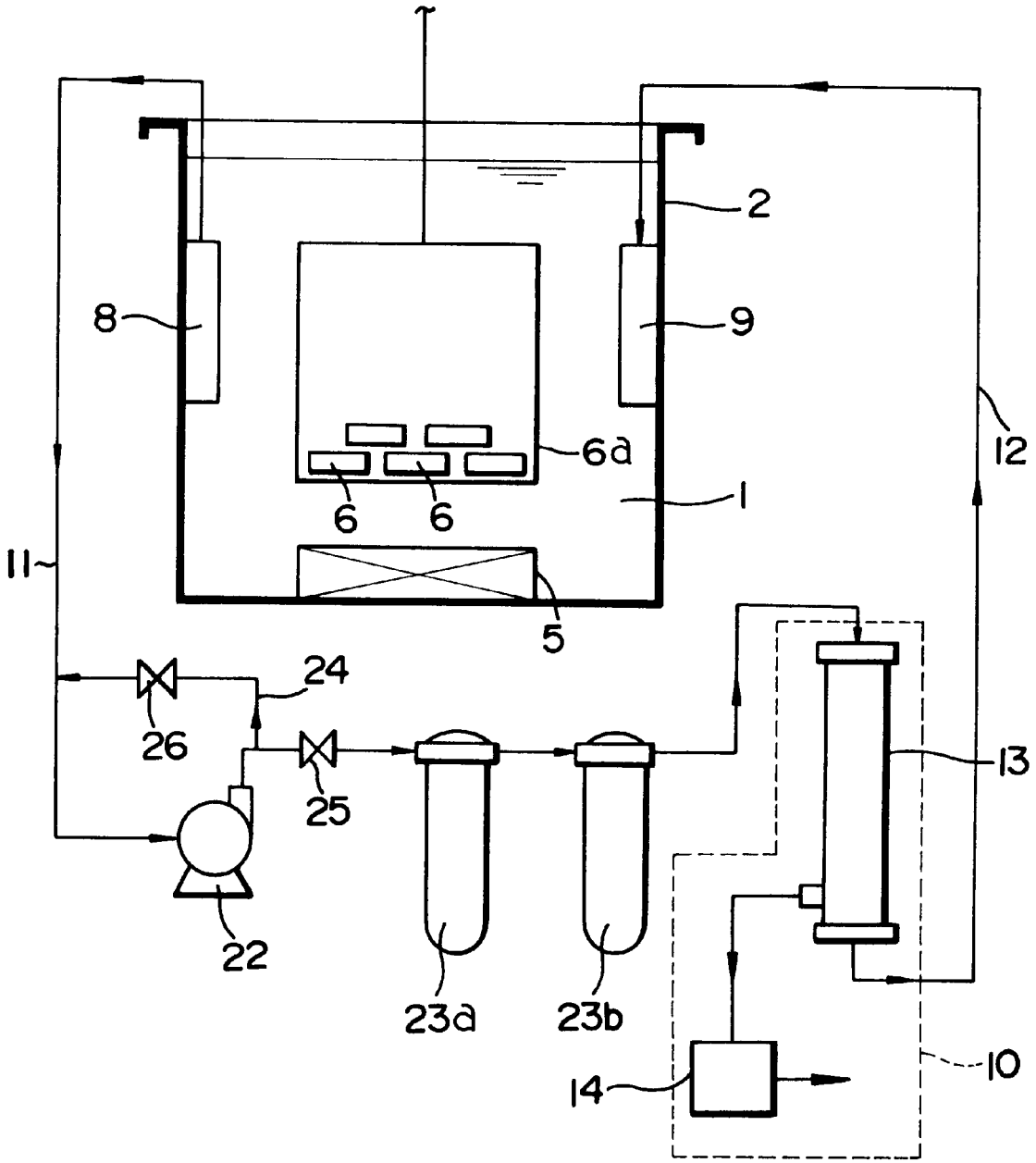
FIG. 2 is a systematic diagram of another ultrasonically cleaning apparatus for carrying out the method of ultrasonically cleaning a workpiece according to the present invention.

In the ultrasonic cleaning apparatus shown in FIG. 2, the cleaning solution 1 contained in the ultrasonic cleaning tank 2 is drawn from the cleaning solution outlet 8 into the discharge conduit 11 by the circulation pump 22, and then supplied to the filters 23*a*, 23*b*. The cleaning solution 1 contains burrs and foreign matter removed from the workpieces 6 by the ultrasonic cleaning process in the ultrasonic cleaning tank 2. The filter 23*a* removes relatively large burrs and foreign matter having dimensions of 5 μm or greater, and the filter 23*b* removes smaller burrs and foreign matter having dimensions of up to 2 μm. Then, the cleaning solution 1 from the filters 23*a*, 23*b* is introduced into the deaerator 10, which deaerates the cleaning solution 1 to a desired dissolved oxygen content, and the deaerated cleaning solution 1 is supplied through the supply conduit 12 and the cleaning solution inlet 9 to the ultrasonic cleaning tank 2.

Experiment 1

Tap water was supplied as the cleaning solution 1 to the ultrasonic cleaning tank 2, and instead of the workpieces 6 and the container 6*a*, a plate of pure aluminum having dimensions of 100 mm×100 mm×10 mm was immersed in the cleaning solution 1 perpendicularly to the ultrasonic vibrator 5, the plate of pure aluminum having an upper edge positioned 50 mm below the surface level of the cleaning solution 1. The lower edge of the plate of pure aluminum did not reach the ultrasonic vibrator 5, and was spaced 50 mm or more from the ultrasonic vibrator 5.

Then, ultrasonic energy was radiated from the ultrasonic vibrator 5 into the cleaning solution 1 to produce microjets that eroded the aluminum plate. During the ultrasonic cleaning process, the aluminum plate was vertically moved a vertical distance of 25 mm for uniform exposure to the microjets.

The amount of oxygen dissolved in the cleaning solution 1 was varied stepwise between 0.05 to 9 ppm. The ultrasonic cleaning process was carried out for 60 minutes with respect to each of the dissolved oxygen contents. After each ultrasonic cleaning process, the aluminum plate was pulled out, and an erosion-induced reduction in the weight of the aluminum plate was measured as being indicative of the intensity of applied microjets. The greater the eroded amount of aluminum, the greater the reduction in the weight of the aluminum plate, indicating a greater microjet intensity. The weight was measured ten times for each of the dissolved oxygen contents, and the average value was used as the eroded amount of aluminum at the dissolved oxygen content.

The cleaning solution 1 was kept at a normal temperature ranging from 20 to 25° C. In the ultrasonic cleaning tank 2, the cleaning solution 1 was directed as a laminar flow from the cleaning solution inlet 9 to the cleaning solution outlet 8 parallel to the ultrasonic vibrator 5. The ultrasonic vibrator 5 radiated ultrasonic energy having an intensity of 600 W at a single frequency of 28 KHz. The output watt density of the ultrasonic vibrator 5 was 1 W/cm$^2$ at maximum.

The results of Experiment 1 are shown in Table 1 below, and also by the curve defined by the solid dots in the graph of FIG. 3. Table 1 shows the relationship between the amount of oxygen dissolved in the cleaning solution 1 and the eroded amount of aluminum as ultrasonically cleaned.

TABLE 1

| | | | | | | | |
|---|---|---|---|---|---|---|---|
| A(ppm) | 0.07 | 0.2 | 0.4 | 0.7 | 1.2 | 1.9 | 2.1 |
| B(mg) | 492 | 466 | 465 | 455 | 435 | 420 | 370 |
| A(ppm) | 3.2 | 4.4 | 5.4 | 5.7 | 6.2 | 6.9 | |
| B(mg) | 250 | 175 | 85 | 42.0 | 15.8 | 15.2 | |

A: Amount of oxygen dissolved in the cleaning solution, and
B: Eroded amount of aluminum.

It can be seen from Table 1 and FIG. 3 that the intensity of microjets is maximum below the dissolved oxygen content of about 0.5 ppm, and gradually decreases to the dissolved oxygen content of about 2 ppm, and that the intensity of microjets decreases substantially linearly as the dissolved oxygen content increases until the dissolved oxygen content reaches about 6 ppm, and the eroded amount of aluminum reaches a substantially constant level of 15 to 16 mg once the dissolved oxygen content exceeds 7 ppm or higher. A detailed study of the experimental results indicates that the microjets have an intensity sufficient to clean the aluminum plate when the dissolved oxygen content is of about 5 ppm or lower, do not produce an effective cleaning effect when the dissolved oxygen content is higher than about 5 ppm, and produces almost no cleaning effect when the dissolved oxygen content is of 7 ppm or higher.

Figure 3:
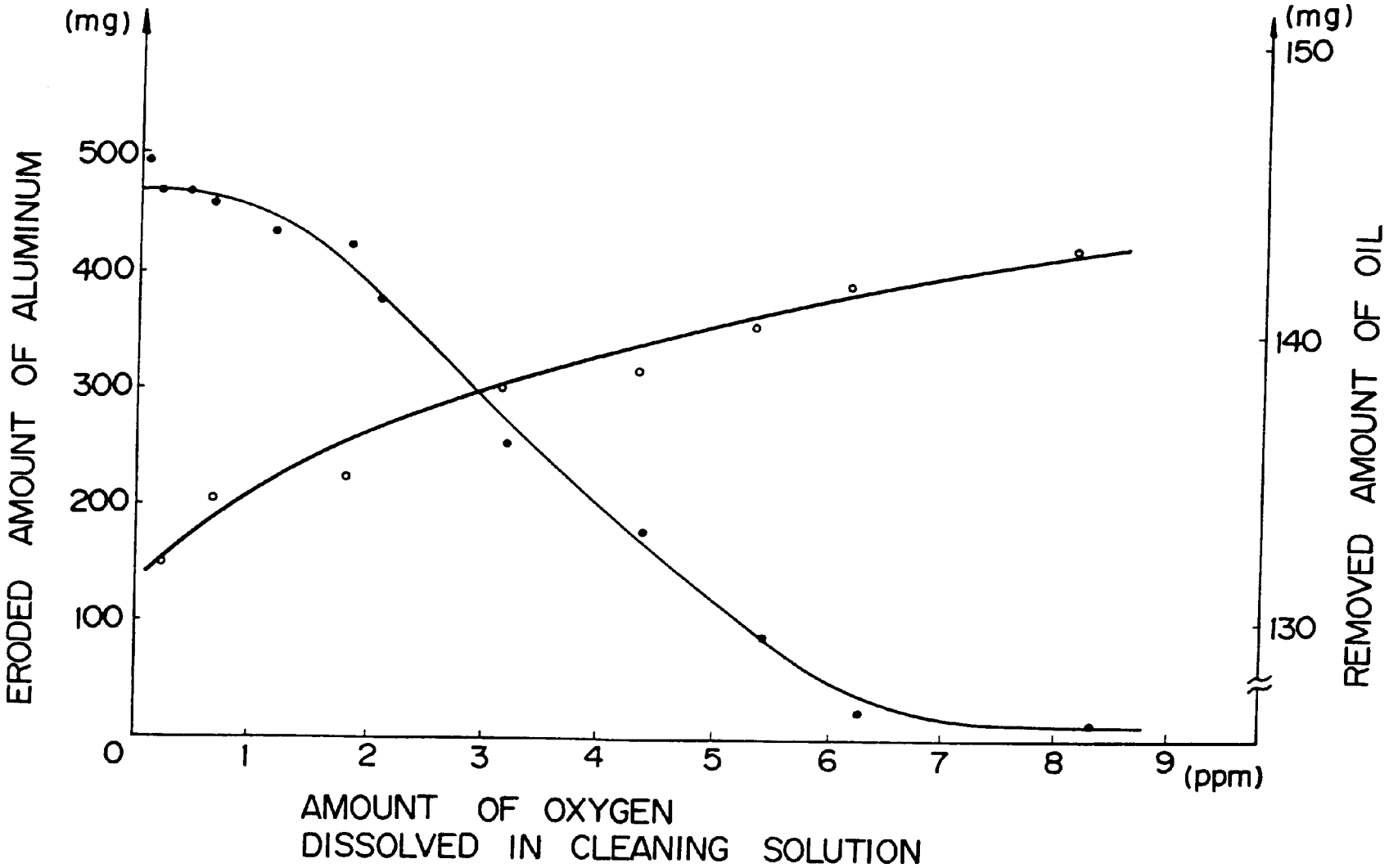
FIG. 3 is a graph showing the relationship between the amount of oxygen dissolved in a cleaning solution, the intensity of microjets produced when cavities are collapsed in the cleaning solution, and the amount of removed oil.

The difference between eroded amounts of aluminum when the dissolved oxygen content is higher and lower than 0.5 ppm is not clearly seen from Table 1 and FIG. 3. However, the results of the actual cleaning process show that the burrs of workpieces are fully removed when the dissolved oxygen content is 0.5 ppm or lower, indicating a clear difference with the cleaning process when the dissolved oxygen content being in excess of 0.5 ppm.

Experiment 2

The following experiment was conducted to check the relationship between the amount of oxygen dissolved in the cleaning solution and the removed amount of oil:

A specimen was prepared by grinding opposite surfaces of an SUS plate having dimensions of 100 mm×100 mm×10 mm with abrasive grain and applying 10 cc of mineral machine oil to the SUS plate. The machine oil applied to the specimen was extracted with carbon tetrachloride, the infrared absorption ratio of the machine oil was measured five times, and the average of the measured values was used as a blank. The blank indicates the amount of machine oil attached to the specimen prior to ultrasonic cleaning, i.e., the initial value of machine oil attached to the specimen, and was 147.6 mg.

Then, a cleaning solution 1 comprising tap water and 5% of a detergent composed of a nonionic surface active agent was supplied to the ultrasonic cleaning tank 2 shown in FIG. 2, and instead of the workpieces 6 and the container 6*a*, the above specimen was immersed in the cleaning solution 1 perpendicularly to the ultrasonic vibrator 5, the specimen having an upper edge positioned 50 mm below the surface level of the cleaning solution 1. The lower edge of the plate of pure aluminum did not reach the ultrasonic vibrator 5, and was spaced 50 mm or more from the ultrasonic vibrator 5.

Then, ultrasonic energy was radiated from the ultrasonic vibrator 5 into the cleaning solution 1 to clean the surfaces of the specimen for thereby removing the machine oil. During the ultrasonic cleaning process, the specimen was vertically moved a vertical distance of 25 mm for uniform exposure to the microjets. The cleaning process was carried out in the same manner as with Experiment 1.

The amount of oxygen dissolved in the cleaning solution 1 was varied stepwise between 0.05 to 9 ppm. The ultrasonic cleaning process was carried out for 60 minutes with respect to each of the dissolved oxygen contents. After each ultrasonic cleaning process, the specimen was pulled out, and hot air was applied directly to the specimen to dry the same at a temperature of 80° C. for 60 seconds. After the specimen was dried, the machine oil attached to the specimen was extracted with carbon tetrachloride, the infrared absorption ratio of the machine oil was measured five times for each of the dissolved oxygen contents, and the average of the measured values was used as an amount of oil attached after the ultrasonic cleaning. The differences between the above blanks and the amounts of oil attached after the ultrasonic cleaning were determined to calculate the amounts of oil removed after the ultrasonic cleaning.

The results of Experiment 2 are shown in Table 2 below, and also by the curve defined by the non-solid dots in the graph of FIG. 3. Table 2 shows the relationship between the amount of oxygen dissolved in the cleaning solution 1 and the amount of oil removed by the ultrasonic cleaning.

TABLE 2

| | | | | | | | | |
|---|---|---|---|---|---|---|---|---|
| A(ppm) | 0.2 | 0.7 | 1.9 | 3.2 | 4.4 | 5.4 | 6.2 | 8.2 |
| B(mg) | 15.5 | 13.3 | 12.6 | 9.5 | 9.1 | 7.4 | 5.8 | 4.6 |
| C(mg) | 132.1 | 134.3 | 135.0 | 138.1 | 138.5 | 140.2 | 141.8 | 143.0 |

A: Amount of oxygen dissolved in the cleaning solution,
B: Amount of oil attached after cleaning, and
C: Amount of oil removed after cleaning.
Wherein the amount of oil removed after cleaning equals the above-mentioned blank amount (147.6) minus the amount of oil attached after the cleaning.

It can be seen from Table 2 and FIG. 3 that the amount of oil removed is small when the amount of oxygen dissolved in the cleaning solution 1 is less than 2 ppm, and increases as the amount of dissolved oxygen increases.

A detailed study of the experimental results indicates that when the dissolved oxygen content is less than 2 ppm, the oil attached to the specimen is removed by the microjets and then becomes attached again to the specimen. Solid foreign matter applied to the specimen when the oil reattaches to the specimen cannot easily be removed even if intensive microjets are applied. It is also found that in the dissolved oxygen content range of from 2 to 5 ppm, since relatively strong microjets are applied to the specimen, the oil and the solid foreign matter applied to the specimen can easily be removed, and since the oil can easily be emulsified and dispersed in the cleaning solution by the dissolved gas, both the oil and the solid foreign matter can be removed. It is also found that when the dissolved oxygen content is in excess of 5 ppm, most of the oil is removed, but the oil absorbed into the specimen remains, and that as the microjets are very weak at this time, the solid foreign matter attached to the specimen by the remaining oil cannot easily be removed.

The ultrasonic cleaning apparatus shown in FIG. 2 is practical enough to be effective for use as a tabletop ultrasonic cleaning apparatus for cleaning small parts as well as an experimental ultrasonic cleaning apparatus.

Although certain preferred embodiments of the present invention have been shown and described in detail, it should be understood that various changes and modifications may be made therein without departing from the scope of the appended claims.

What is claimed is:

1. A method of ultrasonically cleaning a workpiece, said workpiece having foreign matter attached thereto by oil, comprising the steps of:

deaerating a non-chlorofluorocarbon aqueous cleaning solution containing a surface active agent to a dissolved oxygen content ranging from 2 to 5 ppm;

heating said cleaning solution to a temperature ranging from 30° to 55° C.;

supplying an ultrasonic cleaning tank having an ultrasonic vibrator mounted on a bottom thereof with said aqueous cleaning solution which has been deaerated to said dissolved oxygen content;

immersing a workpiece in said cleaning solution; and radiating ultrasonic energy from the ultrasonic vibrator into the cleaning solution to remove said foreign matter attached to said workpiece by oil, and burrs, off the workpiece.

2. A method according to claim 1, further comprising the step of deaerating the cleaning solution by introducing the cleaning solution into a sealed tank and evacuating the sealed tank to discharge a gas dissolved in the cleaning solution into a space in the sealed tank.

3. A method of ultrasonically cleaning a workpiece, comprising the steps of:

deaerating a first non-chlorofluorocarbon aqueous cleaning solution to a first dissolved oxygen content ranging from 2 to 5 ppm for removing solid foreign matter attached to said workpiece by oil;

deaerating a second non-chlorofluorocarbon aqueous cleaning solution to a second dissolved oxygen content different from said first dissolved oxygen content and ranging from 0.01 to 5 ppm for removing burrs from said workpiece;

heating said first and second aqueous cleaning solutions to a temperature ranging from 30° to 55° C.;

supplying a first ultrasonic cleaning tank having an ultrasonic vibrator mounted on a bottom thereof with said first aqueous cleaning solution which has been deaerated to said first dissolved oxygen content;

supplying a second ultrasonic cleaning tank having an ultrasonic vibrator mounted on a bottom thereof with said second aqueous cleaning solution which has been deaerated to said second dissolved oxygen content;

immersing a workpiece in said first cleaning solution in said first ultrasonic cleaning tank;

radiating ultrasonic energy from the ultrasonic vibrator in the first cleaning tank to remove said solid foreign matter attached to said workpiece by oil off the workpiece;

immersing said workpiece in said second cleaning solution in said second cleaning tank; and radiating ultrasonic energy from the ultrasonic vibrator in the second cleaning tank to remove said burrs off the workpiece.

* * * * *